United States Patent [19]

Jackson et al.

[11] 4,003,209

[45] Jan. 18, 1977

[54] PIER CONSTRUCTION

[76] Inventors: Gary A. Jackson, 4565 W. Donges Lane, Milwaukee, Wis. 53223; Donald R. Jackson, 17625 W. Senlec Lane, Brookfield, Wis. 53005

[22] Filed: July 31, 1972

[21] Appl. No.: 276,666

[52] U.S. Cl. ..... 61/48; 248/216.1

[51] Int. Cl.[2] ..... E02B 3/20

[58] Field of Search ..... 61/48, 46, 63; 114/5 F, 114/5 R; 52/656, 263; 248/221

[56] References Cited

UNITED STATES PATENTS

| | | | |
|---|---|---|---|
| 882,835 | 3/1908 | McGillivray | 248/221 X |
| 1,480,147 | 1/1924 | Brandt | 248/221 X |
| 1,646,725 | 10/1927 | Davidson | 52/263 X |
| 1,763,069 | 6/1930 | Schuler | 248/221 |
| 1,912,049 | 5/1933 | Voorhees | 61/48 |
| 2,687,617 | 8/1954 | Newell | 61/48 |
| 2,753,019 | 7/1956 | Phane | 52/263 X |
| 3,022,759 | 2/1962 | McCall | 61/48 X |
| 3,046,748 | 7/1962 | Monroe | 61/48 |
| 3,131,542 | 5/1964 | Koch | 114/5 F X |
| 3,158,003 | 11/1964 | Dally | 61/48 X |
| 3,324,614 | 6/1967 | Loewenau | 52/263 X |
| 3,345,825 | 10/1967 | Parker | 61/48 |
| 3,470,700 | 10/1969 | Quaine et al. | 61/48 |
| 3,625,463 | 12/1971 | Scholz | 248/221 |

FOREIGN PATENTS OR APPLICATIONS

| | | | |
|---|---|---|---|
| 1,463,794 | 11/1966 | France | 61/48 |

*Primary Examiner*—Dennis L. Taylor
*Attorney, Agent, or Firm*—Michael, Best & Friedrich

[57] ABSTRACT

Disclosed herein is a method of constructing a pile supported pier comprising the steps of sinking a plurality of piles in general alignment, movably locating on each of the piles a cross support, transversely aligning the cross supports with one another, fixing the aligned cross supports to the respective piles in aligned position, and attaching a prefabricated deck assembly to the cross supports.

Also disclosed herein is a pier construction comprising a pile driven through the water and into the earth and including a portion normally located above the water, a cross support extending through the pile portion below the top of the pile, respective hangers supported at each of the ends of said cross support, a shelf including a plate and a plurality of gussets welded to the pile above the cross support with the plate in generally horizontal position at the top of the pile, a cross beam welded to the plate in transverse relation to the pile and to the cross support, respective hangers supported at each of the ends of the cross beam, a first deck assembly supported on the hangers on the cross support, and a second deck assembly supported on the hangers on the cross beam.

9 Claims, 7 Drawing Figures

Fig. 2
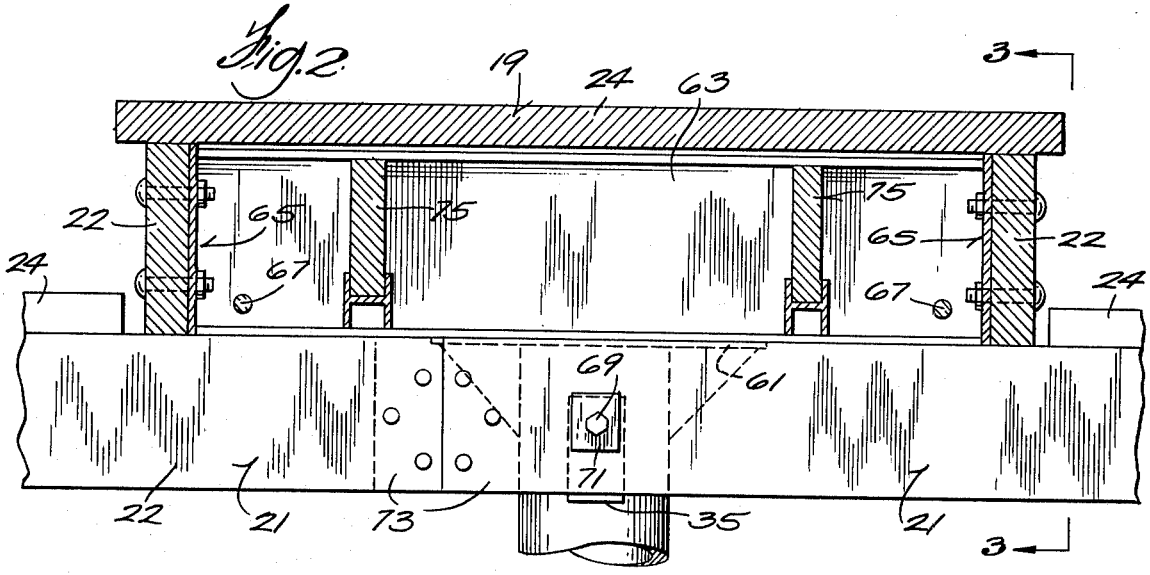
Fig. 3
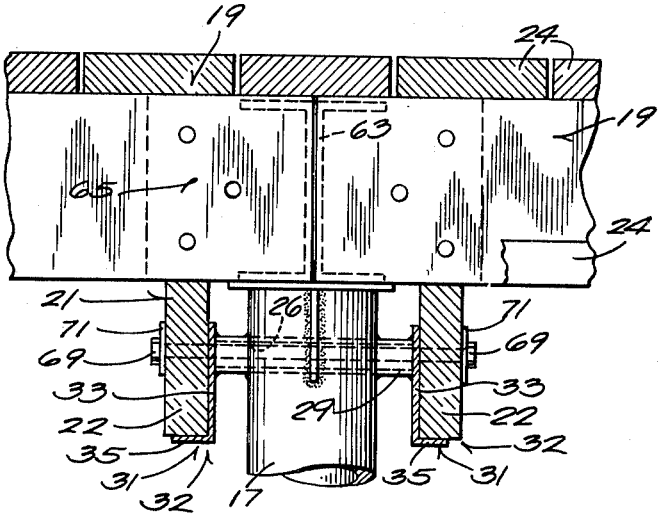
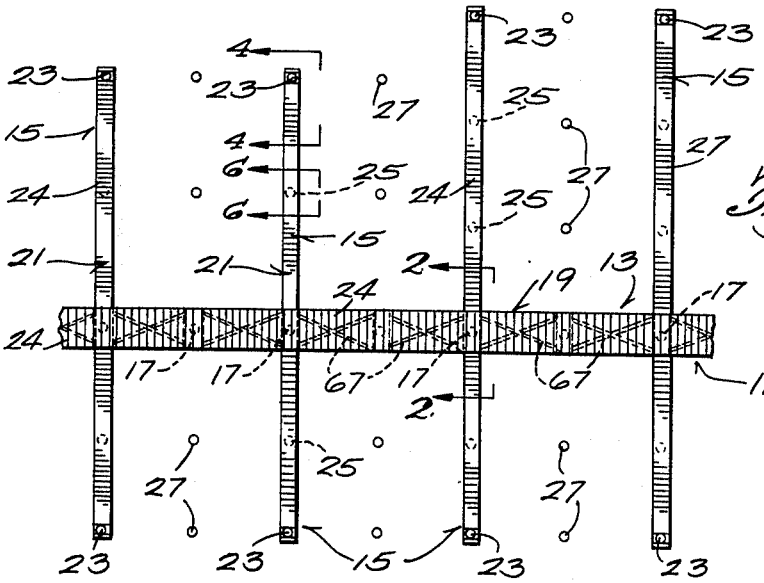
Fig. 1

PIER CONSTRUCTION

BACKGROUND OF THE INVENTION

The invention relates generally to pier constructions and, more particularly, to pile supported pier structures and to methods of manufacturing such piers. In the past, much time and effort has been spent when constructing pile supported piers in carefully aligning the piles in the sub-structure. In addition, far more piles than structurally required were often employed. Still further, in addition, such piers were commonly almost entirely constructed on the site. Such pier construction has been relatively very expensive.

SUMMARY OF THE INVENTION

The invention provides a pier construction wherein a prefabricated deck assembly is supported by a plurality of piles seated in the earth. The invention involves both the resulting structure and the method of obtaining the resulting structure. Furthermore, the invention greatly reduces the cost of construction by eliminating the previous practice of carefully aligning the piles and by employing fewer piles and by maximum utilization of components which have been prefabricated at a remote site so as to avoid the danger and expense of working above water.

A pier in accordance with the invention is constructed by sinking into the earth a plurality of piles in generally aligned relation (as contrasted to precise alignment), movably locating on each of such piles a transverse cross member or support, aligning the transverse cross supports, fixing the aligned transverse cross supports in aligned position, and attaching a prefabricated deck assembly to the cross supports. Preferably, the cross supports are at least partially prefabricated by fixing to at least one of the ends thereof a hanger from which the deck assembly is supported. In some instances, the cross supports can be prefabricated by fixing hangers at both ends.

In accordance with one feature of the invention, the hangers comprise an L-shaped member having a leg which extends horizontally in underlying supporting engagement with a stringer of a supported deck assembly.

Further in accordance with one feature of the invention, at least some of the piles are provided with cross supports or members for each of a finger pier and a main pier. In such circumstances, the cross supports extend transversely to each other and the finger pier is located below the main pier (In other words, the main pier can rest, in part, on the finger pier).

Other objects and advantages of the invention will become known by reference to the following description, claims and accompanying drawings.

DRAWINGS

FIG. 1 is a fragmentary plan view of a pier construction embodying various of the features of the invention.

FIG. 2 is a fragmentary, enlarged view taken along line 2—2 of FIG. 1.

FIG. 3 is a fragmentary view taken along line 3—3 of FIG. 2.

Figure 4:
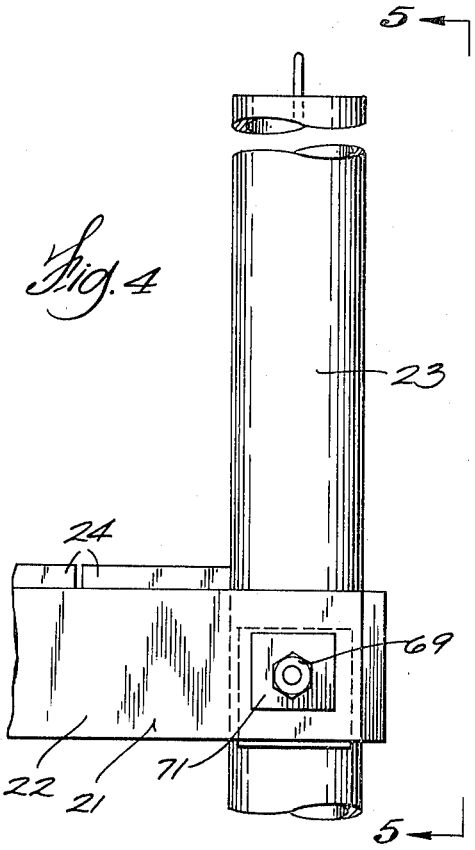
FIG. 4 is a fragmentary, enlarged view taken along line 4—4 of FIG. 1.
Figure 5:
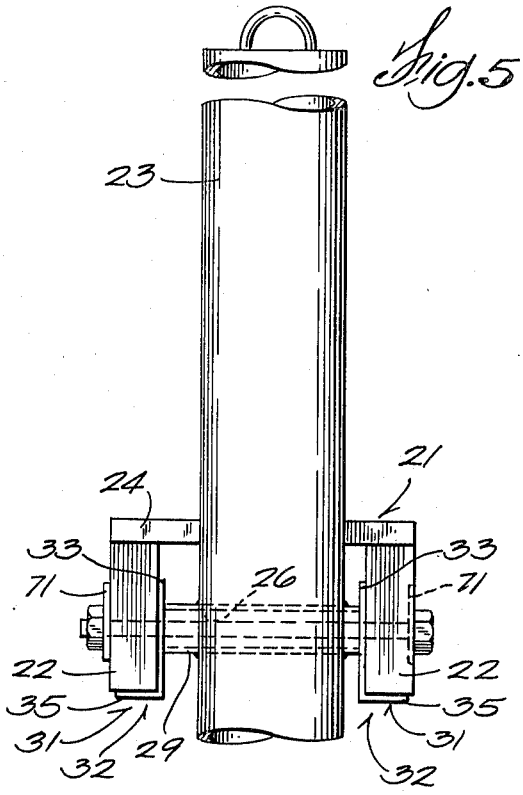
FIG. 5 is a fragmentary view taken along line 5—5 of FIG. 4.

Before explaining the invention in detail, it is to be understood that the invention is not limited in its application to the details of construction and arrangement of parts set forth in the following general description or illustrated in the accompanying drawings, since the invention is capable of other embodiments and of being practiced or carried out in various ways. Also, it is to be understood that the phraseoloty or terminology employed herein is for the purpose of description and not of limitation.

GENERAL DESCRIPTION

Shown in FIG. 1 of the drawings is a pier 11 which embodies various of the features of the invention. The pier 11 conventionally includes a main pier or walkway 13, together with a plurality of finger piers 15 which can extend for different lengths from both sides of the main pier 13 with the oppositely extending finger piers 15 preferably being aligned with each other transversely of the main pier 13.

The main pier 13 includes a plurality of generally aligned and spaced piles 17 on which there is supported a deck assembly 19 comprising a plurality of sections which are preferably prefabricated at a point remote from the site. In addition, other of the components are preferably prefabricated at a remote point.

Each of the finger piers 15 includes a deck assembly 21 which can comprise one or more prefabricated sections and which, at its outer end, is supported by an outer finger pier pile 23. The deck assembly 21 is supported, adjacent to the main pier 13, by one of the main pier piles 17 and is supported, intermediate the outer pile 23 and main pier pile 17 by one or more intermediate piles 25 depending upon the length of the finger pier 15. As with respect to the main pier 13, the finger pier deck assembly sections are preferably prefabricated at a remote spot, together with certain other components of the construction.

The finger pier deck assemblies 21 (See FIG. 2), as well as the sections of the main deck assembly 19, comprise, as illustrated, spaced parallel stringers 22 which are connected by cross deck boards 24.

Located between the finger piers 15 (See FIG. 1) are a plurality of spring piles 27.

In accordance with the method and structure of the invention, the piles 17, 23, and 25 are first sunk in proper location and cut off at the proper height above the water. In this regard, the intermediate piles 25 are cut off at the lowest level, the main pier piles 17 are cut off at a higher level, and the outer piles 23 of the finger piers 15 are cut off at a still higher level.

The piles 17, 23, and 25 are then adapted to successively receive the finger pier deck assemblies 21 and the main pier deck assembly sections. More particularly in accordance with the invention, the main pier piles 17 which also support the finger piers 15, and the outer piles 23 of the finger piers 15, are (See FIG. 3) initially transversely pierced, as for instance, by burning, to provide therein transverse diametric bores or holes 26. Subsequently, a transverse cross support or member 29 is inserted through the diametric bores or holes 26.

The finger pier cross supports 29 for each finger pier 15 are then adjusted transversely of the associated piles 17 and 23 until their ends are in alignment. The finger pier cross supports 29 are then welded or otherwise permanently fixed to the piles 17 and 23 with the cross support ends in alignment. Thus, any misalignment between the piles 17 and 23 is readily compensated for by adjusting the relationship of the cross supports 29 relative to the piles 17 and 23.

While the cross supports 29 can take various forms, in the illustrated and preferred construction, the cross supports 29 have a hollow interior and are tubular in cross section.

Each of the ends of the cross supports 29 includes a hanger 31 which can be constructed in various ways and which can include a plate apertured to facilitate bolting thereto of a stringer 22 of an associated deck assembly. In the preferred and illustrated construction, the hangers 31 comprise L-shaped support brackets 32 including a vertical leg 33 which is welded to the associated end of the cross support 29 and a lower horizontal leg 35 which extends outwardly to support the under-surface of one stringer 22 of an associated deck assembly. Preferably, the vertical leg 33 is apertured to afford access through the hollow interior of the cross support 29.

It is preferred to prefabricate the cross supports 29 by attaching at least one support bracket 32 at a remote site. Such prefabrication does not adversely affect transverse adjustment of the cross supports 29 prior to welding to the piles 17 and 23 in order to achieve the desired alignment. Such prefabrication also reduces the amount of on-site work done above the water.

Figure 6:
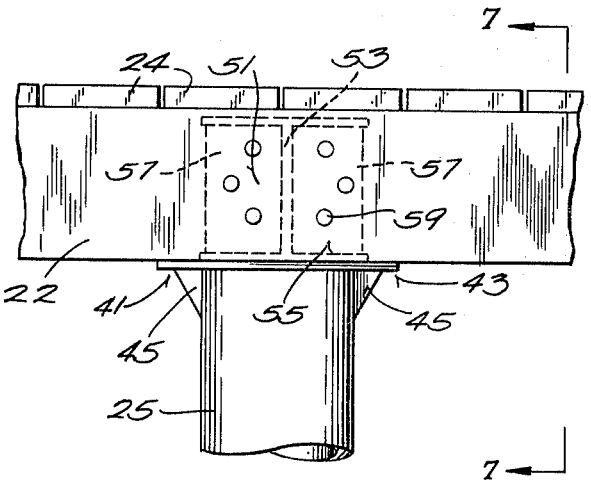
FIG. 6 is a fragmentary, enlarged view taken along line 6—6 of FIG. 1.
Figure 7:
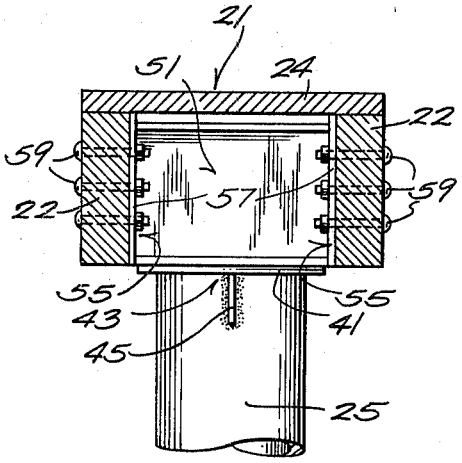
FIG. 7 is a fragmentary view taken along line 7—7 of FIG. 6.

The intermediate piles 25 are prepared for support of a prefabricated finger pier deck assembly 21 by installation, at the top of each pile 25 (See FIGS. 6 and 7), of a horizontal shelf or plate 41 which is welded or otherwise permanently fixed to the top of the associated intermediate pile 25 and which is preferably larger in horizontal dimension than the horizontal cross section of the associated intermediate pile 25. While the plate or shelf 41 could be welded directly to the top of the associated intermediate pile 25, it is preferred to employ a shelf bracket 43 which includes the plate 41 and at least one gusset or rib 45 extending perpendicularly to the plate 41. In the preferred construction, at least two such gussets 45 in diametrically opposed relation, spaced slightly more than the outer diameter of the associated intermediate pile 25, are employed. During the construction, the shelf bracket 43 is placed on the top of the associated intermediate pile 25 and vertical welds are made between the gussets 45 and the pile when the plate 41 is horizontally located at the proper height.

After connection of the shelf 41 to the intermediate pile 25, a transverse cross beam, member, or support 51 is located on the shelf or plate 41 and transversely adjusted so that its ends are in alignment with the ends of the cross supports 29. The cross beams 51 are then welded or otherwise permanently fixed to the associated shelf 41. Thus, as with respect to the cross supports 29, the method of construction affords compensation for misalignment of the piles.

While other structural forms could be used, in the illustrated construction, the cross beams 51 are of H-beam shape and are arranged with the web 53 extending vertically. As with the cross supports 29, the cross beams 51 include, at each end, a hanger 55 which is welded or otherwise permanently fixed to the cross beam end, preferably at a site remote from the point of installation. While L-shaped hangers, such as the hangers 31, could be employed, in the illustrated construction, the hangers 55 comprise flat plates which are suitably apertured to receive bolts 59 which, in the finished construction, also extend through the associated stringers 24. The use of plates 57 on the cross beams 51 is also beneficial as it permits, during assembly, support of the ends of the finger pier deck assembly 21 by the horizontal legs 35 of the support bracket 32, whereby to compensate for minor misalignments in vertical height between the hangers 31 and 55.

The main pier piles 17 are preferably also prepared to support the main deck assembly 19, as well as the finger pier deck assemblies 21. In this regard, the main pier piles 17, as already noted, are cut off above the top of the intermediate piles 23 and are each provided (See FIG. 2) with shelves 61, cross beams 63 and hangers 65, such as the shelves 41 provided by the shelf brackets 43, the cross beams 51 and hangers 53, as already explained with respect to the intermediate finger pier piles 25. No further explanation is believed to be necessary, except to note that rectilinear misalignment of the main pier piles 17 can be readily compensated for by alignment of the cross beams 63 prior to welding of otherwise fixedly attaching the cross beam 63 to the shelves 61. If desired, the hangers 65 can comprise either brackets, such as the support brackets 32, or plates, such as the plates 57.

As can be seen from FIG. 1, in the illustrated construction, every other main pier pile 17 also supports a finger pier 15 and includes a cross support arrangement as already described, as well as a shelf arrangement. It is also to be noted that in the finished construction, the main pier 13 is located above the finger piers 15, i.e. the finger pier deck assemblies 21 are at a level which extends under the main pier deck assembly 19.

After fixed attachment of the cross beams 63 to the main pier piles 17, crossed or diagonal tie rods 67 (See FIG. 1) can be attached to the main pier cross beam 63 to provide additional rigidity.

After all the finger pier supporting piles have been provided with the cross supports 29 or 52, the prefabricated finger pier deck assemblies 21 can be lowered onto the horizontal legs 35 of the support brackets 32 fixed to the outer piles 21 and to the main pier piles 17. In the instance where the tubular cross supports 29 are employed, an elongated cross bolt 69 extending through the hollow interior of the associated cross support 29 can be employed to fix the deck assemblies 21 to the cross supports 29. Enlarged washers 71 at each of the ends of the cross bolt 69 can also be employed adjacent to the outer surface of the stringers.

While the finger pier hangers 31 on the main pier piles 17 could be lengthened as desired to receive the inner ends of the stringers 22 of both of the oppositely extending finger piers 15, in the illustrated construction, the inner ends of the stringers 22 from only one of the opposed finger piers 15 are connected to the hangers 31 and the inner ends of the stringers 22 of the opposed finger pier 15 are connected by bolted fish plates 73 to the inner ends of the stringers 22 supported on the brackets 32.

After the finger pier deck assemblies 21 are in place, the sections of the main pier deck assembly 17 can be laid upon the finger pier deck assemblies 21 and bolted to the hangers 65 on the main pier cross beams 63. If the width of the main pier 13 is relatively large, additional stringers 75 extending between adjacent H-beam cross beams 65 can be employed to provide additional support to the middle of the deck boards 24.

If desired, the various piles 17, 23 and 25 can be filled with concrete after fixed attachment of the cross supports 29 and before fixed attachment of the shelves 41 and 61 to the top of the piles 17 and 25. It is also noted that the outer finger pier piles 21 extend well above the finger pier level while the other piles terminate below the deck assemblies.

The finger pier deck assemblies 21 and the sections of the main pier deck assembly 19 can all be fabricated remotely from the site and lowered by boom onto the pilings. Thus, a major portion of the work involved in constructing the piers is removed from the site and removed from the dangers of working above water. In addition, the connection of the cross members 29, 51, and 63 to the piles 17, 23, and 25 is such as to accommodate any misalignment of the piles and thereby to avoid the tedious and expensive pile aligning operations which have been previously employed. Still further, it is particularly noted that the main pier 13 and the finger piers 15 are supported by single piling structures and that certain of the single piles under the main pier 13 also serve as supports for the finger piers 15. It is also noted that the deck boards 24 are supported solely through the stringers 22 which, in turn, are supported by the hangers. Thus, there is no direct support of the deck boards 24 by the cross members 29, 51, and 63.

Various of the features of the invention are set forth in the following claims.

What is claimed is:

1. A method of constructing a pile supported pier comprising the steps of sinking a plurality of piles in general alignment, prefabricating a plurality of cross supports with hangers at one end, locating on each of said piles one of the cross members, moving the cross members on the piles to locate the cross members in aligned parallel relation to one another, fixing the aligned cross members to the respective piles in aligned position, and securing a deck assembly to the hangers.

2. A method of constructing a pier comprising the steps of sinking a pile into the earth with a portion extending vertically above a normal water level, providing a transverse bore in the portion of the pile above water, prefabricating a cross support which is tubular and which includes a hanger at one end thereof, inserting the cross support in the bore in the pile portion above water, adjusting the cross support transversely of the pile, fixing the cross support in transversely adjusted position relative to the pile, and connecting a deck assembly to the hanger outwardly of the end of the cross supporting including placing of a bolt through the hollow interior of the cross support.

3. In a pier construction, a pile driven through the water and into the earth and including a portion normally located above the water, a transverse member extending through said pile portion below the top of said pile, respective hangers supported at each of the ends of said transverse member, a shelf including a plate and a plurality of gussets arranged perpendicularly to said plate and welded to said pile to locate said plate in generally horizontal position at the top of said pile, and a cross beam welded to said plate in transverse relation to said pile and in transverse relation to said transverse member, said cross beam including, at the transversely opposed ends, respective hangers supported at each of the ends of said cross beam.

4. In a pier construction in accordance with claim 3 wherein said hangers on said transverse member comprise a vertically extending leg and a horizontal leg and wherein said pier construction includes a deck assembly including a stringer located in horizontally abuting outward relation to said vertical leg and resting in engagement on said horizontal leg.

5. In a pier construction, a pile having a portion normally extending above water, a plate fixed in generally horizontal position at the top of said pile, and a cross beam fixed to said plate in transverse relation to said pile and having transversely opposed unsupported free ends, said cross beam including, at said transversely opposed free ends, respective vertically extending hangers, a deck assembly supported in part by said pile and including stringers extending lengthwise along the margin of said deck assembly, and fastening means securing said stringers to said hangers.

6. In a pier construction in accordance with claim 5 wherein said plate is a part of a shelf bracket including a plurality of gussets arranged perpendicularly to said plate and welded to said pile.

7. In a pier construction, a pile driven through the water and into the earth and including a portion normally located above the water, a transverse member extending horizontally through said pile portion below the top of said pile, respective hangers supported at each of the ends of said transverse member, a plate fixed to the top of said pile in generally horizontal position, a cross beam fixed to said plate in transverse relation to said pile and in transverse relation to said transverse member, and respective hangers supported at each of the ends of said cross beam.

8. In a pier construction in accordance with claim 7 and further including a first deck assembly supported by said hangers on said transverse member and a second deck assembly supported by said hangers on said cross beam.

9. In a pier construction in accordance with claim 8 wherein said first deck assembly extends transversely to said second deck assembly and wherein said second deck assembly extends above said first deck assembly.

* * * * *